US006209732B1

(12) United States Patent
Dennis et al.

(10) Patent No.: US 6,209,732 B1
(45) Date of Patent: Apr. 3, 2001

(54) CURLING IRON HOLDER

(76) Inventors: Bernice R. Dennis; Osborne E. Dennis, both of 1300 Grayhorse Rd., Greensboro, GA (US) 30642-3502

( * ) Notice: Subject to any disclaimer, the term of this patent is extended or adjusted under 35 U.S.C. 154(b) by 0 days.

(21) Appl. No.: 09/330,777

(22) Filed: Jun. 11, 1999

Related U.S. Application Data

(60) Provisional application No. 60/090,117, filed on Jun. 22, 1998.

(51) Int. Cl.[7] ..... A47F 7/00

(52) U.S. Cl. ..... 211/70.6; 248/117.2

(58) Field of Search ..... 211/70.6, 181.1, 211/195; 248/117.1–117.7, 153, 175; D6/566, 462, 458

(56) References Cited

U.S. PATENT DOCUMENTS

| | | | | |
|---|---|---|---|---|
| D. 216,690 | * | 3/1970 | Robak | D6/566 |
| D. 243,559 | | 3/1977 | Hoyle et al. . | |
| D. 260,463 | * | 9/1981 | Imus | D6/468 |
| D. 287,203 | | 12/1986 | Jenkins et al. . | |
| D. 305,944 | | 2/1990 | Mellott . | |
| D. 329,304 | | 9/1992 | Tipp . | |
| D. 332,670 | | 1/1993 | McFarland . | |
| D. 340,824 | * | 11/1993 | Pujals, Jr. | D6/566 |
| D. 342,585 | | 12/1993 | Fischbach et al. . | |
| D. 346,243 | | 4/1994 | Weber . | |
| D. 373,849 | | 9/1996 | Passalacqua . | |
| D. 400,037 | * | 10/1998 | Bartholow | D6/566 |
| D. 401,461 | * | 11/1998 | Laga | D6/566 |
| 1,502,385 | | 7/1924 | Hauenstein . | |
| 3,267,254 | * | 8/1966 | Weller et al. | 248/117.5 |
| 3,523,666 | * | 8/1970 | Bloodsworth | 211/70.6 |
| 3,964,708 | | 6/1976 | Reeves . | |
| 4,046,260 | * | 9/1977 | Tallon | 211/195 |
| 4,093,171 | | 6/1978 | Mengo, Sr. . | |
| 4,103,145 | | 7/1978 | Oliveri . | |
| 4,308,878 | | 1/1982 | Silva . | |
| 4,354,093 | | 10/1982 | Zago . | |
| 4,672,703 | * | 6/1987 | Frazier | 211/70.6 |
| 4,700,847 | * | 10/1987 | Shieh | 211/195 |
| 4,762,979 | | 8/1988 | Geoffroi . | |
| 4,871,074 | * | 10/1989 | Bryson et al. | 211/70.6 |
| 4,973,019 | | 11/1990 | Baird et al. . | |
| 5,031,778 | | 7/1991 | Edgecombe . | |
| 5,090,649 | | 2/1992 | Tipp . | |
| 5,402,899 | * | 4/1995 | Ammeson | 248/117.2 |
| 5,826,731 | * | 10/1998 | Dardashti | 211/181.1 |

* cited by examiner

*Primary Examiner*—Daniel P. Stodola
*Assistant Examiner*—Jennifer E. Novosad
(74) *Attorney, Agent, or Firm*—Barry E. Kaplan, Esq.; Hughes & Kaplan

(57) ABSTRACT

A hair curling iron support device for holding a hair curling iron, or other styling implement, away from a horizontal or vertical resting surface. The holder is provided with a generally "U" or "V"-shaped, weighted base having at least one support member affixed thereto. A ring support member having a plurality of spaced apart rings are affixed to the support member. In alternate embodiments, multiple pluralities of spaced apart rings are provided to accommodate additional hair curling iron units.

14 Claims, 2 Drawing Sheets

CURLING IRON HOLDER

RELATED APPLICATIONS

The inventors hereof claim priority based upon and pursuant to provisional patent application Ser. No. 60/090,117 filed on Jun. 22, 1998.

FIELD OF THE INVENTION

This invention relates to a portable electric curling iron holder and more particularly to a portable electric curling iron holder having an array of ring-like protection, support, and heat sink members.

BACKGROUND OF THE INVENTION

Individuals and styling salons often use hair curling irons as a standard part of the hair dressing art. Often, however, the stylist will activate the curling iron only to later discover that the iron has become hot enough to burn the table top or other surface upon which it may be resting. Cautious individuals will sometimes hold the iron during heating and cooling cycles, causing inconvenience and limitation of their activities.

In an attempt to solve this common problem, others have provided holders of varying design and construction for use with hair curling irons and the like. Examples of such devices may be seen with reference to the following: U.S. Pat. No. Des. 243,559 to Hoyle et al.; U.S. Pat. No. 4,103,145 to Oliveri; U.S. Pat. No. 4,308,878 to Silva; U.S. Pat. No. 4,973,019 to Baird et al.; U.S. Pat. No. 5,090,649 and U.S. Pat. No. Des. 329,304 to Tipp; and, U.S. Pat. No. Des. 332,670 to McFarland.

Some of these prior art holders have tended to be large or bulky, and sometimes inconvenient to store. Other prior art holders have been difficult to transport, whether from room to room or when packed in luggage for a trip. Others do not conveniently accommodate the variety of sizes and designs of curling irons that are currently available to the stylist.

Furthermore, several of the prior art devices do not provide adequate air ventilation or heat sink capacity to enable the iron to cool rapidly following its use. Additionally, the enclosed nature of some prior art devices may tend to trap hair, dust, and other debris, which can then become dangerous when placed adjacent the hot curling iron.

It is readily apparent that an improved hair curling iron holder is needed to overcome the drawbacks apparent in the prior art, and to render more safe and convenient the use of the hair curling iron implement. It is, therefore, to the provision of such an improved hair curling iron holder that the present invention is directed.

Accordingly, the several objectives of the present invention are:

- to provide a hair curling iron holder that is lightweight and small enough to conveniently transport or store;
- to provide a hair curling iron holder that may act as an insulated heat sink and that is sufficiently open to the air in order to enable appropriate cooling of the curling iron;
- to provide a hair curling iron holder that deters injurious casual contact from a user;
- to provide a hair curling iron holder that may be mounted in a horizontal or vertical configuration;
- to provide a hair curling iron holder that will accommodate a wide variety of sizes, weights, and designs of curling irons;

- to provide a hair curling iron holder that which will not trap hair, dust, or other debris; and,
- to provide a hair curling iron holder that is economical to manufacture, heat resistant, and simple in its design.

Other objects, features, and advantages of the present invention will become apparent to those skilled in the art by reference to the drawings and to the detailed description of the preferred embodiment presented herein.

BRIEF SUMMARY OF THE INVENTION

In accordance with the several objectives of the present invention, provided is a hair curling iron holder having a generally V or U-shaped, weighted base. The base is provided with non-skid material and may have mounting holes provided therethrough. From the base extends at least one support member. To the at least one support member is affixed a ring support member, preferably angled with respect to the base. Affixed at approximately equidistant, spaced apart intervals upon the ring support member are a plurality of ring members of sufficient diameter to accommodate the barrel of a conventional hair curling iron. The hair curling iron holder, either in whole or in part, may be coated with a heat resistant material, or may be otherwise insulated against heat transference between the curling iron holder and the user's casual touch.

Alternate configurations of the hair curling iron holder of the present invention are disclosed in which the holder may be provided with a plurality of ring support members, along with their respective plurality of ring members. In a first alternative embodiment, for example, a side-by-side configuration is disclosed. In a second alternative embodiment embodiment, a multi-tier arrangement is disclosed. It is within the contemplation of the present invention that further alternate embodiments may be provided having multi-tier or in multiple side-by-side configurations.

BRIEF DESCRIPTION OF THE DRAWINGS

The invention is better understood by reading the Detailed Description of the Preferred Embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF PREFERRED EMBODIMENTS

In describing preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Figure 1:
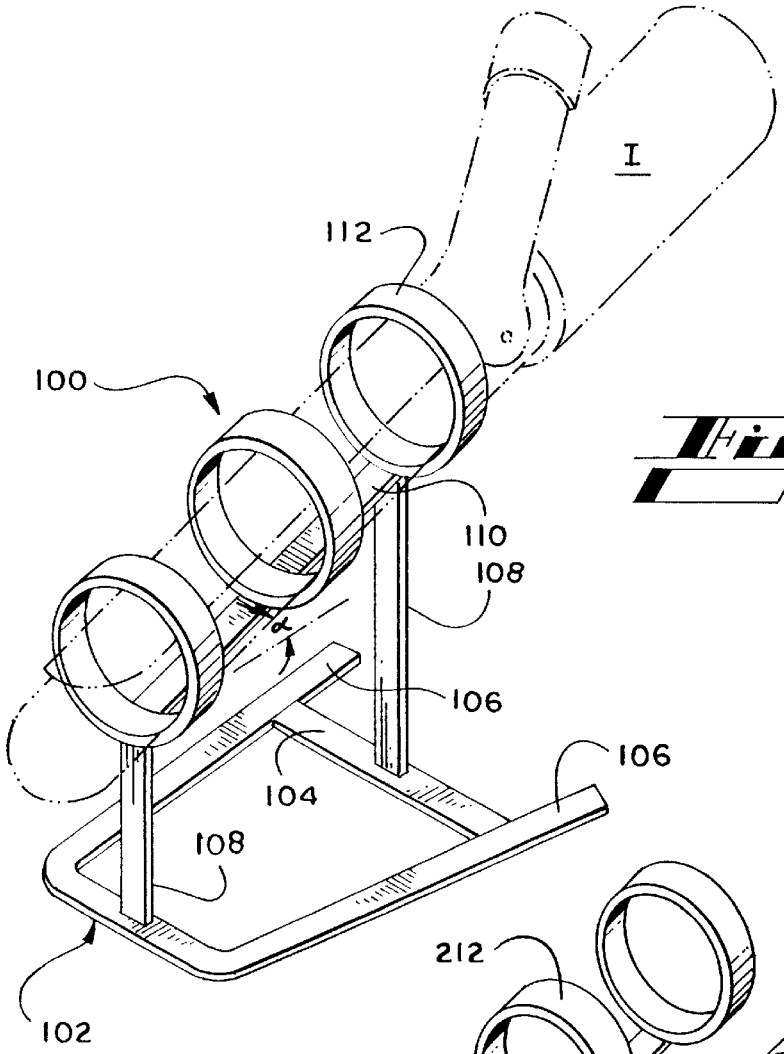
FIG. 1 is a perspective view of the preferred embodiment of the hair curling iron holder of the present invention, and further illustrating the use thereof with a hair curling iron.

Shown in FIG. 1 is the preferred embodiment of the hair curling iron holder 100 of the present invention. FIG. 1 and further illustrates the use of the holder 100 with a hair curling iron I of conventional design. The preferred embodiment of the present invention is manufactured of approximately rectangular cross-section, thin gauge steel. The holder 100, however, may be manufactured from other materials which are well known in the art, and which may have any of a variety of cross-sections, so long as the materials so selected are strong, yet lightweight, and heat resistant to the temperatures achieved by conventional hair curling irons. The material may be coated or otherwise treated in selected zones in a manner well known in the art to provide additional thermal insulating properties, all without departing from the spirit of the disclosed invention. A material such as Firebarrier & Caulk CP25WB (3M Corporation, St. Paul, Minn.) has been found effective for such purposes.

As shown in FIG. 1, an outwardly opening, generally "U"-shaped, weighted base 102 is provided, the base preferably having at least one cross brace 104 for stabilizing the legs 106 of the base 102. The base optionally may be provided with mounting holes for mounting the base to a horizontal or vertical support surface. From the base 102 extends at least one support member 108, but preferably two, for enhanced stability of the holder 100. Attached to at least one of support member 108 is a ring support member 110. The ring support member 110 is preferably angled, as at $\alpha$, with respect to the base 102. The ring support member 110 typically is affixed to the at least one support member 108 through welding or other conventional means of affixation. While the angle $\alpha$ of the ring support member 110 is preferably approximately forty-five (45) degrees, it will be appreciated by those skilled in the art that the angle $\alpha$ may be modified, or otherwise varied, to suit the size and weight of the hair curling iron I, the preferences of the user, and the normal incident angle for the insertion of the hair curling iron into the holder 100. Affixed to the ring support member 110 are a plurality of rings 112. The rings 112 preferably are sized to accommodate the barrel of a conventional hair curling iron I. The rings 112 may be spaced along the ring support member 110 in any manner that is visually appealing and convenient to the use described herein, although approximately equidistant spacing is demonstrated in the illustrations of the preferred and alternate embodiments.

Figure 2:
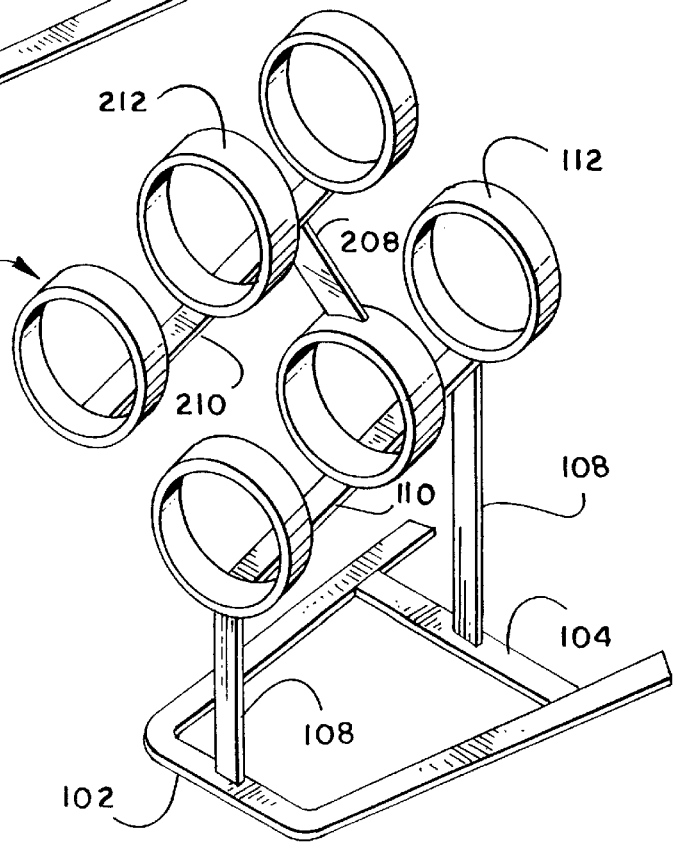
FIG. 2 is a perspective view of a first alternative embodiment of the hair curling iron holder of the present invention.

FIG. 2 demonstrates a first alternate embodiment of the hair curling iron holder 200 of the present invention. It will be seen that an additional support member 208 is affixed to one of the plurality of rings 112. To this support member 208 is affixed a second ring support member 210, having a second plurality of rings 212. It can be seen that the holder 200, so provided, conveniently may accommodate either a second hair curling iron or another hair styling implement, such as a blow dryer.

It will be appreciated by those ordinarily skilled in the art that the support member 208 of this second tier may be affixed at any convenient location upon the first tier without departing from the intended manner of construction or use of the holder 200. The second tier may be parallel to the first, as measured according to the centerlines of the ring support members 110, 210, or may be further slightly angled to accommodate the needs of the user and the aesthetics of the holder 200.

Figure 3:
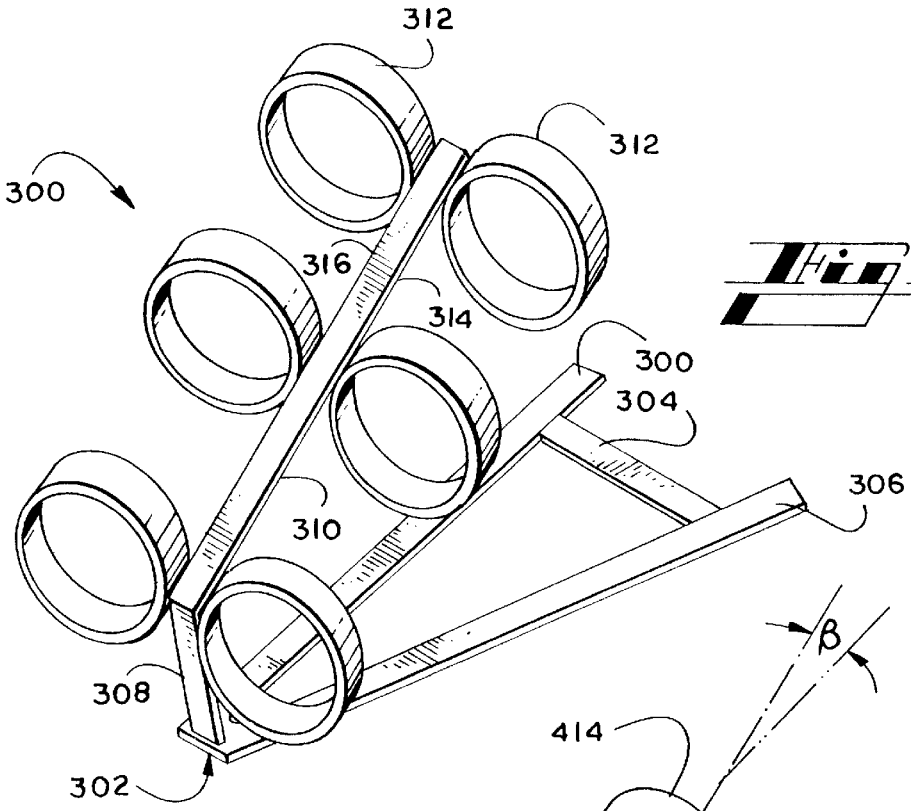
FIG. 3 is a perspective view of a second alternative embodiment of the hair curling iron holder of the present invention; and, FIG. 4 is an perspective view of a third alternative embodiment of the hair curling iron holder of the present invention.

Shown in FIG. 3 is a second alternative embodiment of the hair curling iron holder 300 of the present invention. In this embodiment, weighted base 302 is provided in a "V"-shaped configuration, the base 302 preferably having at least one cross brace 304 for stabilizing the legs 306 of the base 302, and at least one support member 308. It will be seen that ring support member 310 is affixed to support member 308 and further accommodates a first plurality of rings 312 adjacent edge 314 of the ring support member 310, and a second plurality of rings 312 adjacent the opposite edge 316 of the ring support member 310. In this configuration, either one or two hair curling irons, or other hair styling implements, conveniently may be accommodated by the holder 300.

Figure 4:
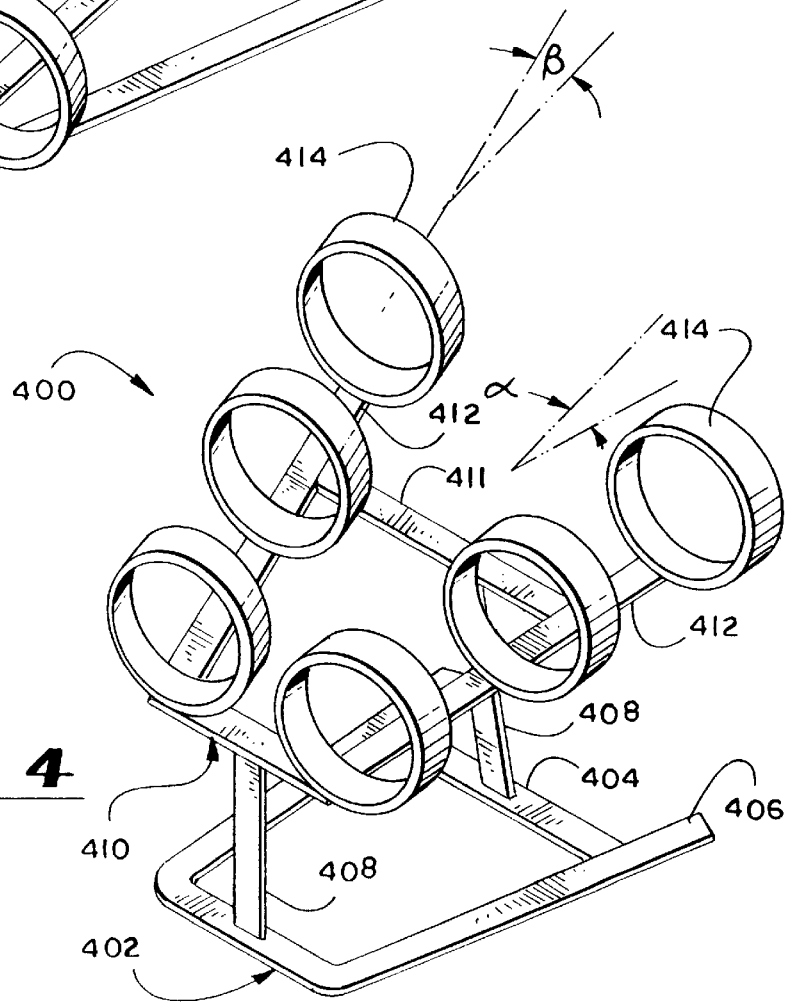

Shown in FIG. 4 is a third alternate embodiment of the hair curling iron holder 400 of the present invention. In this embodiment is provided a "U"-shaped base 402. From base 402 are preferably two support members 408, serving to stabilize the legs 406 of the base 402. The two support members 408 have at their upper end an outwardly opening pair of ring support members 412, generally formed into an assembly 410 having a "U"-shaped configuration. The pair of ring support members 412 may have a cross brace 411 for stabilizing the ring support members 412 of the assembly 410 and for affixing a support member 408. To the pair of ring support members 412 are affixed a first plurality of rings 414 adjacent to the first ring support member 412, and adjacent to the second ring support member 412 are affixed a second plurality of rings 414. In this configuration, either one or two hair curling irons, or other hair styling implements, conveniently may be accommodated by the holder 400. It will be seen that the angle $\alpha'$, with regard to the plane of base 402, and the angle $\beta$, with regard to the central axis, or centerline, of each ring support member 412, may be varied to accommodate design aesthetics, convenience of insertion and removal of the hair curling irons, and the size and configuration of the hair curling irons to be used. All such variations are considered to be within this scope and spirit of the disclosure of the present invention.

It will be appreciated that the base may have a non-skid material glued, or otherwise affixed, to the bottom surface. This non-skid material may be of rubber, or of other non-marring, friction enhancing material, as well-known in the art. It will be appreciated that the holder conveniently will rest without toppling upon a flat horizontal surface, such as a countertop. The base of the holder, however, may further be provided with mounting holes and hardware, hook and loop fastener fabric, or other mounting implements, all well-known in the art, to permit a user of the holder to removably affix the holder to a mounting surface, such as a countertop or wall.

In illustrating the operation of the device, reference is again made to FIG. 1. A hair curling iron I is inserted into a first plurality of rings 112 along their central axis. As the weight of the hair curling iron I is generally centered near its handle, the open "U" or "V"-shaped base 102 prevents the holder 100 from toppling or overturning. The spaced apart configuration provided by the plurality of rings 112 accommodates air circulation about the curling iron barrel. Thus, the curling iron I, properly disconnected, may be cooled relatively rapidly for safety and storage purposes. The holder 100 also provides an insulated heat sink, further enhancing the usefulness of the device. The plurality of rings 112 further provide a reasonable level of protection against a user accidentally touching the hot curling iron surface. It will be appreciated by those skilled in the art, however, that a mesh-like screen, or equivalent, may optionally be provided to further enhance the safe use of the device.

It will be appreciated by those ordinarily skilled in the art that the device may be provided with pivotal joints and stop means, all in a manner well-known in the art, to enable the base, rings, and various support members to be folded into a flat configuration, or varied with regard to the various angles of use discussed hereinabove. The holder may be further modified to provide additional pluralities of rings in order to accommodate three, four, or a greater number of hair curling irons or styling implements.

Having thus described exemplary embodiments of the present invention, it should be noted by those ordinarily skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A curling iron support apparatus comprising a base; a support member extending from said base; a plurality of ring support members angularly extending from said support member, said ring support members being disposed vertically in tiers; and, at least two rings of approximately equal internal diameters affixed to each of said ring support members in spaced-apart and approximately parallel relationship, said rings having approximately rectangular cross-sections.

2. The curling iron support apparatus of claim 1 wherein said support member is a plurality of support members.

3. The curling iron support apparatus of claim 1 wherein each of said tiers comprises a plurality of ring support members.

4. The curling iron support apparatus of claim 3 wherein the centerlines of said ring support members on each tier are disposed in approximately coplanar relationship.

5. The curling iron support apparatus of claim 1 wherein said at least two rings is a plurality of rings disposed in pairs about said ring support member.

6. A curling iron support apparatus comprising a base having a front portion and a rear portion, said base outwardly opening toward said front portion; a support member extending approximately vertically from said base, said support member having approximately a rectangular cross-section; a plurality of ring support members angularly extending from said support member, said ring support members having approximately a rectangular cross-section, said ring support members being disposed vertically in tiers; and, a plurality of rings of approximately equal internal diameters affixed to said ring support members in spaced-apart and approximately parallel relationship, said plurality of rings having approximately rectangular cross-sections.

7. The curling iron support apparatus of claim 6 wherein said support member is a plurality of support members.

8. The curling iron support apparatus of claim 6 wherein the centerlines of said ring support members on each tier are disposed in approximately coplanar relationship.

9. A curling iron support apparatus comprising:

a base having at least three members positioned generally in the shape of an "A", said generally A-shaped base having an upper portion corresponding to the closed end of the "A", a middle portion corresponding to the horizontal line of the "A" and a lower portion corresponding to the open end of the "A";

at least one support member carried by said base at said upper portion and extending approximately vertically therefrom, said support member having a first end and a second end;

a plurality of ring support members angularly extending from said at least one support member, said ring support members being disposed vertically in tiers; and, a plurality of rings affixed to said ring support members in spaced-apart and approximately parallel relationship, each of said rings having approximately the same dimensions.

10. The curling iron support apparatus of claim 9 comprising at least two of said support members, wherein at least one of said support members is carried by said base at said middle portion, and extending approximately vertically therefrom.

11. The curling iron support apparatus of claim 9 wherein each of said tiers comprises a plurality of ring support members.

12. The curling iron support apparatus of claim 9 wherein said rings are disposed in pairs about said ring support members.

13. The curling iron support apparatus of claim 9 wherein said base has means for affixing the apparatus to a surface.

14. The curling iron support apparatus of claim 9 wherein said base further comprises a friction enhancing bottom surface.

* * * * *